United States Patent [19]

den Hartog

[11] Patent Number: 4,887,970

[45] Date of Patent: Dec. 19, 1989

[54] CLAMP FOR CONNECTING TOGETHER A GROUND LEAD AND A GROUND ROD

[75] Inventor: Gerardus J. H. den Hartog, Nunspeet, Netherlands

[73] Assignee: Aarding Non Ferro Werk B.V., Nunspeet, Netherlands

[21] Appl. No.: 216,870

[22] Filed: Jul. 8, 1988

[30] Foreign Application Priority Data

Jul. 23, 1987 [NL] Netherlands ..... 8701746

[51] Int. Cl.[4] ..... H01R 4/66

[52] U.S. Cl. ..... 439/92; 174/7

[58] Field of Search ..... 174/7; 439/92, 100

[56] References Cited

U.S. PATENT DOCUMENTS 4,156,793 5/1979 Carlson .

FOREIGN PATENT DOCUMENTS 250812 4/1963 Australia ..... 174/7
1118060 2/1982 Canada ..... 174/7
1765581 6/1968 Fed. Rep. of Germany .
2368155 6/1978 France ..... 174/7
476677 2/1972 Japan ..... 174/7
1041899 9/1966 United Kingdom ..... 174/7

*Primary Examiner*—Eugene F. Desmond
*Attorney, Agent, or Firm*—Ralph M. Burton

[57] ABSTRACT

Clamp for connecting together a ground lead and a ground rod comprising a clamp body with a cavity which surrounds the rod, said cavity is a blind cavity which is conical at least over a part of its length. The clamp body further has a solid section in which a separate hole is provided in which a wire is secured by compression, said wire projecting outside the hole by a length such that it is possible to connect this wire to another wire.

The compression joint between the piece of wire and the clamp body can now be produced in the factory. At the site it is quite simple to connect the ground lead with the piece of wire compressed in the clamp.

3 Claims, 1 Drawing Sheet

CLAMP FOR CONNECTING TOGETHER A GROUND LEAD AND A GROUND ROD

SUBJECT OF THE INVENTION

The invention relates to a clamp for connecting together a ground lead and a ground rod or ground electrode, comprising a clamp body with a cavity which surrounds the electrode.

DESCRIPTION OF THE PRIOR ART

Hitherto, it was customary in practice to provide such clamps with an axial cavity having a shape and dimensions such that a ground rod and the wire of the ground lead to be connected thereto could be simultaneously accommodated therein, after which said two parts were firmly clamped with respect to each other by tightening one or two screw bolts arranged transversely to the direction of the centre line. The most important drawback of said screw bolts is that, which each individual clamp, there is again the risk of an unsatisfactory contact between the wire and the ground rod. It was therefore necessary at least to check said connection, but it was not possible to exclude deterioration in the quality of the contact, and therefore an increase in the contact resistance, in the course of time.

It is possible per se to achieve a permanently satisfactory connection between a clamp and a wire if the wire can be secured in the clamp by compression. For this reason, sufficient force is not usually available at the site.

From U.S. Pat No. 4,156,793 a clamp for the same purpose is known which comprises a threaded bore with which it is to be driven onto the ground rod. At the level of the blind end of the bore two coaxial openings are provides in opposite locations of the wall. Through these openings the ground lead can be inserted which is then, by driving the clamp onto the ground rod, clamped in between the terminal face of the rod and the blind end face of the bore. This clamp presents basically the same drawbacks as the one discussed earlier: the risk of unsatisfactory contact and of increase in the contact resistance in the course of time.

OBJECTS OF THE INVENTION

The object of the invention is therefore to provide a new clamp for connecting a ground lead and a ground rod which can be easily provided at the site and which achieves a perfectly reliable contact connection.

SUMMARY OF THE INVENTION

The clamp according to the invention is characterized in that said cavity is a blind cavity which is conical at least over a part of its length and wherein the clamp body further has a solid section in which a separate hole is provided in which a wire is secured by compression, said wire projecting outside the hole by a length such that it is possible to connect this wire to another wire.

The compression joint between the solid section of the clamp body and the piece of wire can therefore be produced in the factory where there is no problem in exercising a sufficiently large force. The connection between the piece of wire compressed in the clamp body and the ground lead must therefore still be produced at the site. A relatively simple tool such as, for example, a compressing or clamping tool for connecting two wires using a clamping sleeve is available for connecting together said wires. The clamp can be easily fitted by hitting it with one or two hammer blows onto the end of the rod.

The abovementioned separate hole for firmly pressing the piece of wire may be provided in a direction which is parallel to or coincident with the axis of the clamp. It is advantageous if said separate hole is provided at an angle with respect to the centre line of the solid section of the clamp body. On the one hand, a reasonably large length is thereby available for the compression joint whilst, on the other hand, the piece of wire situated outside the clamp is located in a favourable position for making the subsequent connection thereto. The abovementioned angle is preferably approximately 60°.

A satisfactory clamping action and, at the same time, easy installation is achieved, using usual ground rod materials, if the conical cavity is conical over at least part of the length at the closed end of the cavity over a distance which is at least 1.5 times as large as the diameter of the rod for which the clamp is intended, preferably with a half apex angle of the conical section of 20′.

A further advantage of the clamp according to the invention is that the head of the ground rod is protected by said clamp because the latter is located above, like a cap. Internal corrosion on the end—as a result of the fact that it is customary to construct ground rods from a steel core with a copper sheath—is thereby at least reduced and, in practice, completely prevented.

The invention will now be explained with reference to the accompanying drawing of an exemplary embodiment.

DESCRIPTION OF THE PREFERRED EMBODIMENT

Figure 1:
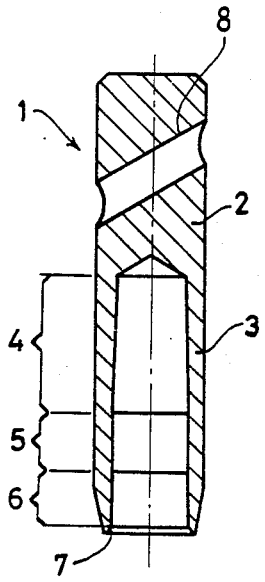
FIG. 1 is an axial cross-section through the clamp body before the wire is fitted.

The clamp body indicated overall by 1 is externally substantially cylindrical. It consists of a solid section 2 and a section 3 in which there is an axial cavity.

Said cavity is formed by a section 4 which, in the direction of the closed end of the hole, tapers conically a cylindrical section 5 connected thereto and a section 6 near the open end which again tapers conically inwards.

The section 6 of the hole ends with a chamfer 7 which fulfils the initial location function.

The cylindrical section 5 has a diameter which is approximately as large as the diameter of the rod for which the clamp is intended. It is possible to make the diameter of the section 5 of the hole, for example, 0.05 mm smaller than the nominal external diameter of the rod, as a result of which there is still no appreciable grip but there is a light and temporary fastening. In the section 4 a conicity is created, the half apex angle of which may be, for example $\frac{1}{3}$° (20′).

With a view to achieving a satisfactory clamping action, the axial length of the section 4 of the hole is at least 1.5 times the value of the diameter of the rod for which the clamp is intended, and in the embodiment drawn is almost twice this value. The length of each of the parts 5 and 6 of the hole may be approximately as large as the diameter.

If the cylindrical section 5 of the clamp has been pushed with manual force at least partially onto the end of the ground rod, an exceptionally firm grip will be achieved by a blow with a hammer on the top of the solid section 2.

Figure 2:
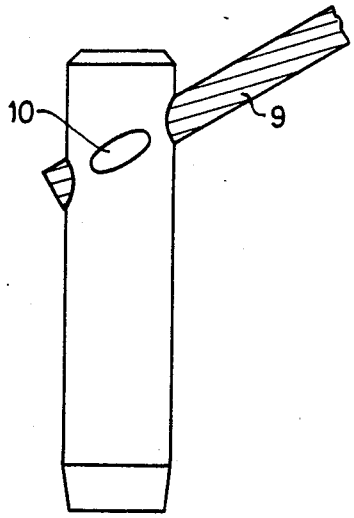
FIG. 2 is a view of the clamp in the completed state.

A hole 8 is provided in the solid section 2 for attaching a piece of wire. It is possible for said hole to be arranged in an axial direction with respect to the clip body, however, the centre line of the hole 8 preferably makes an angle of approximately 60° with the centre line of the clamp body, whilst said centre lines lie in a common plane. In this manner, an effective length of the hole 8 is achieved, which is considerably larger than if the hole were to be provided at right angles to the direction of the centre line of th clamp body. On the other hand, the oblique position is advantageous because, as a result, the end of the wire to be fitted is situated next to the clamp body. A piece of wire, which is indicated by 9 in FIG. 2, is inserted in the hole 8. After insertion, it is secured by compression, which is indicated by the external indentation 10 which is also visible in FIG. 2.

The length of the piece of wire 9 must be chosen so that it is always easy to make a connection to another wire, for example, a ground lead. The length of the piece of wire 9 to be compressed in may be adapted to the wishes of the user. This also applies to the thickness of the wire 9 and therefore to the diameter of the hole 8 to be made which is related thereto.

The clamp body 1 is preferably manufactured in tellurium bronze or tellurium copper; these materials present considerably better conductivity than brass or bronze and, moreover, do not have the drawback of brass, which is corrosionsensitive.

What is claimed is:

1. A clamp for connecting together a ground lead and a ground rod, comprising a clamp body with a cavity which surrounds the rod, wherein said cavity is a blind cavity having a conical portion at the closed end of the cavity extending over a distance which is at least 1.5 times as large as the diameter of the rod for which the clamp is intended, a cylindrical cavity portion contiguous with said conical portion, ending in a conical portion widening near the opening end of the cavity, and wherein the clamp body further has a solid portion in which a separate hole is provided in which a wire is secured by compression, said wire projecting outside the hole at least by a length such that it is possible to connect this wire to another conductor.

2. A clamp as in claim 1, wherein said separate hole is provided at an angle with respect to the center line of the solid portion of the clamp body.

3. A claim as in claim 1 wherein the half apex angle of the conical portion at the closed end of the cavity is 20'.

* * * * *